US006192663B1

(12) United States Patent
Gatlin et al.

(10) Patent No.: US 6,192,663 B1
(45) Date of Patent: Feb. 27, 2001

(54) RIDING SPUR WITH RETAINING LIP

(76) Inventors: Jerry J. Gatlin, 1955 Hardwinter La., Jackson, WY (US) 83002; Trigg Marquiss, P.O. Box 668, Gillette, WY (US) 82717

( * ) Notice: Subject to any disclaimer, the term of this patent is extended or adjusted under 35 U.S.C. 154(b) by 0 days.

(21) Appl. No.: 09/192,257

(22) Filed: Nov. 13, 1998

(51) Int. Cl.[7] ..... A43C 17/04
(52) U.S. Cl. ..... 54/83.1
(58) Field of Search ..... 54/83.1, 83.2

(56) References Cited

U.S. PATENT DOCUMENTS

| | | | | |
|---|---|---|---|---|
| 931,063 | * | 8/1909 | Hayes | 54/83.2 |
| 1,397,966 | * | 11/1921 | Kelly | 54/83.1 |
| 2,454,228 | * | 11/1948 | Smith | 54/83.1 |
| 3,953,958 | * | 5/1976 | Beaston | 54/83.2 |
| 4,443,996 | | 4/1984 | Welton et al. | 54/83.1 |
| 4,513,561 | | 4/1985 | Welton et al. | 54/83.1 |
| 5,046,650 | | 9/1991 | Rothenberg et al. | 233/113 |
| 5,394,677 | | 3/1995 | Van Scoyk | 54/83.1 |

* cited by examiner

*Primary Examiner*—Robert P. Swiatek
(74) *Attorney, Agent, or Firm*—McAndrews, Held & Malloy, Ltd.

(57) ABSTRACT

A riding spur is used in conjunction with a boot having a foot portion and an adjacent heel disposed below the foot portion. The spur comprises a generally U-shaped band member having a lip projecting inwardly from the band member and abutting the lower edge of the band member. The lip is insertable into a gap formed between the heel and the foot portion of the boot. The lip thereby releasably engages the boot between the foot portion of the boot and the heel, and maintains the spur in the proper operating position.

12 Claims, 1 Drawing Sheet

RIDING SPUR WITH RETAINING LIP

FIELD OF THE INVENTION

The present invention relates to equestrian riding equipment, and is particularly directed to the improvement of riding spurs.

BACKGROUND OF THE INVENTION

Applicants Jerry J. Gatlin and Trigg Marquiss are ranchers in Jackson Hole, Wyo., who have used their life-long experiences in horseback riding and training to develop an improved riding spur for the horse-riding and ranching community.

Gatlin first developed his horse-riding skill as a young boy while ranching with his father in Colorado and New Mexico. He then rode professionally in the rodeo for seven years. With his extensive equestrian experience and skill, Gatlin moved to Hollywood and worked for forty years as a stuntman in western movies, fourteen of which starred the movie legend John Wayne.

Marquiss, also an adept horse-rider, rode for years as a professional rodeo rider as well, and showed exceptional skill as a rodeo roper. His expertise in horses ranges from horse riding and ranching to horse breeding, and he is also known for his ability as a horse trainer.

Gatlin returned to ranching in Jackson Hole, Wyoming, after spending many years in Hollywood, and began offering his services as a guide to fishermen and big game hunters in the western wilderness. Gatlin, now semi-retired, often works with Marquiss, who is a full-time rancher in Jackson Hole, Wyoming. Yarquiss and Gatlin, after spending their professional lives working with riding spurs, have developed a riding spur with a retaining lip to fix the problem of their riding spurs from "riding up" while the rider is still in the saddle.

Riding spurs have long been used to encourage a horse to perform at peak ability. Traditionally, a spur has a generally U-shaped metal member, referred to as a band, that fits about the rear of the rider's boot adjacent the heel and has a rearward projection which often carries a point or a rowel having a multiplicity of points. In conventional designs, each spur normally has two straps that are attached to the opposite ends of the band and also serve to releasably attach the spur to the rider's boot. In such conventional designs, one strap passes under the instep of the boot, while the second strap is buckled above the foot of the boot, thereby releasably attaching the spur to the boot. In conventional spur designs, the rear of the heel of the boot frequently urges the band of the spur to ride upward, causing the projection of the spur carrying the point or rowel to extend in a direction that is more or less parallel to the rider's leg. In this position, the spur is of little, if any, effect because the spur cannot adequately contact the horse. Furthermore, once the spur has ridden up in this manner, it must be manually repositioned by he rider, which is often quite difficult and even dangerous to accomplish when the rider is in the saddle.

Prior spur designs have been made to prevent such "riding up" by attaching the upper straps of the spur to the band in a location forward of the lower strap. Prior spur designs have also included a ridge element that can be wedged between the heel of the boot and the upper portion of the boot. For example, Rothenburg U.S. Pat. No. 5,046,650 describes a small rib that extends from the middle of inner surface of the spur collar. In operation, Rothenburg's small rib may not extend fully into the gap or crevice located at the junction of the heel and the foot of the boot, normally made of leather, thereby not fully engaging the spur and not fully preventing the spur from moving from the desired position. In addition, Rothenburg's rib is described as being located within the middle portion of the inside surface of the spur, and is therefore difficult to fixedly attach, by welding or otherwise, to the inside surface of the spur. For these reasons, the prior designs have been inadequate in retaining the spur in its proper position extending from the rider's boot.

SUMMARY OF THE INVENTION

These and other disadvantages inherent in the prior art are overcome by the present improved riding spur. The improved riding spur is simple in design and less expensive to produce than prior, conventional designs, and also overcomes the problem of "riding up" by positively positioning the spur in its proper operating position.

The improved riding spur is intended for use in conjunction with a boot having a foot portion and an adjacent heel disposed below the foot portion. The spur comprises a generally U-shaped band member having a lip or flange projecting inwardly from the band member and abutting the lower edge of the band. The lip is insertable into the gap formed between the heel and the foot portion of the boot. The lip thereby releasably engages the boot between the foot portion and the heel and maintains the spur in its proper operating position.

The improved riding spur preferably further comprises a shaft having a pointed projection extending rearwardly from the band member for engagement with a horse. The pointed projection preferably comprises a rowel. The rowel is most preferably rotatably mounted on the shaft.

DETAILED DESCRIPTION OF THE PREFERRED EMBODIMENT

Figure 1:
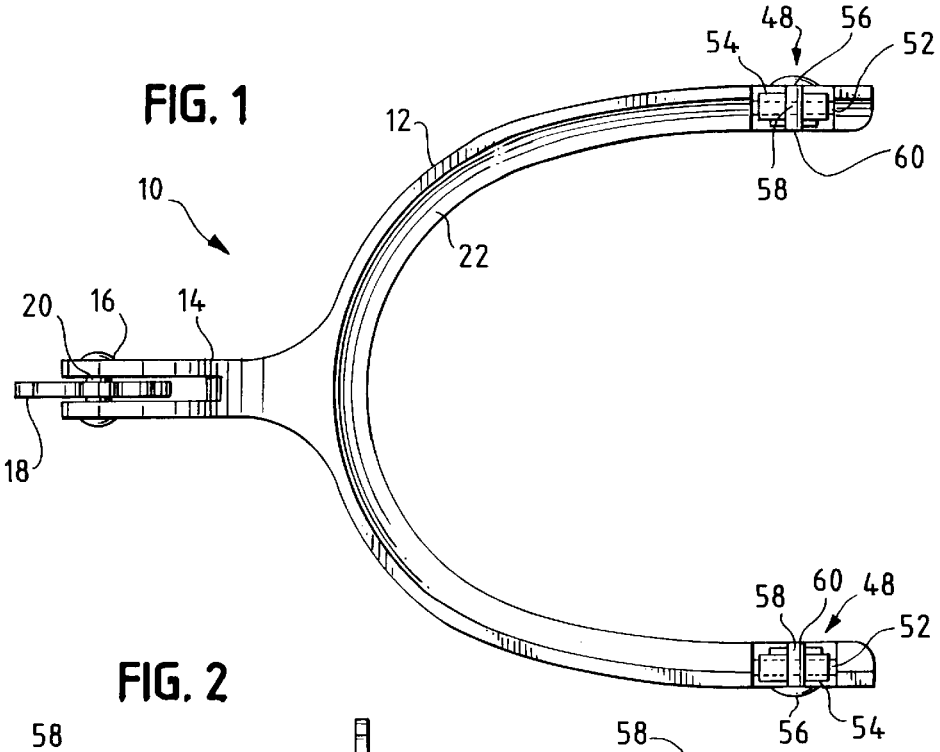
FIG. 1 is a top plan view of one embodiment of an improved riding spur with the straps removed for clarity.
Figure 2:
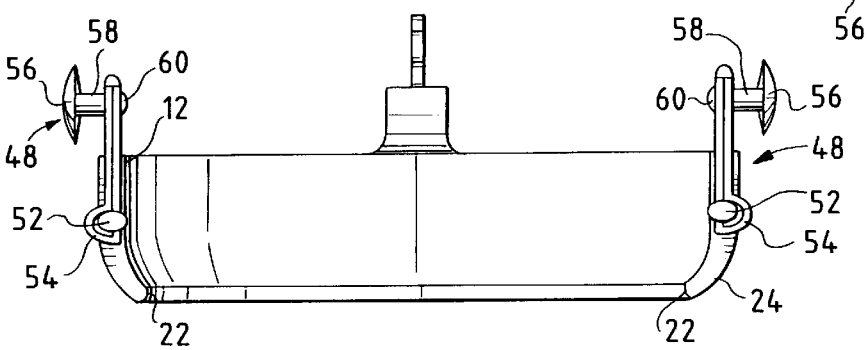
FIG. 2 is a front elevation view of the riding spur of FIG. 1.
Figure 3:
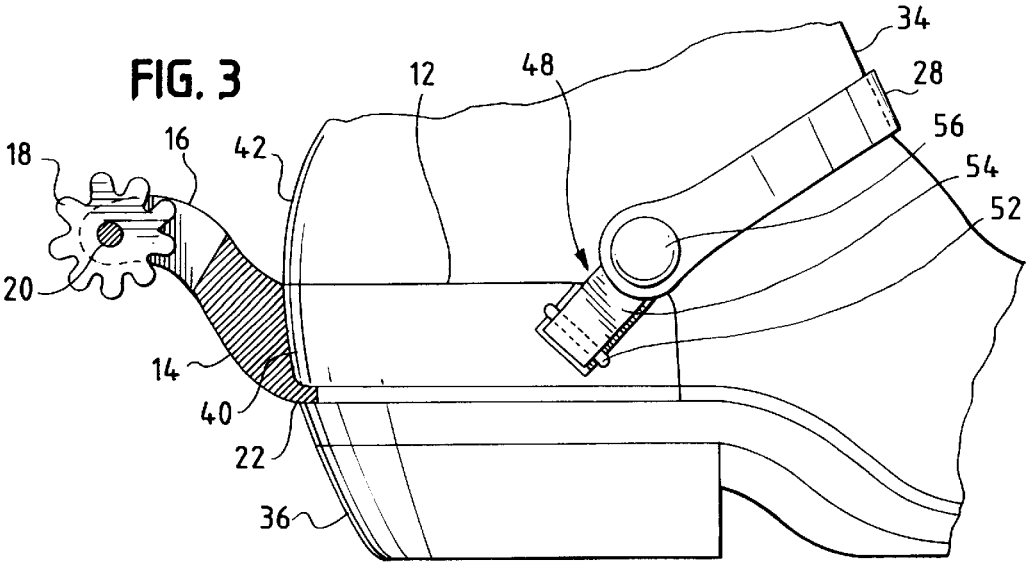
FIG. 3 is a side view, partially in section, of the riding spur of FIGS. 1 and 2 attached to a boot.

FIGS. 1–3 show one embodiment of the improved riding spur, chosen for purposes of illustration. The riding spur, generally indicated in FIGS. 1 and 2 as spur 10, comprises a generally U-shaped band member 12 having a rearwardly projecting shank 14 formed with a bifurcated end portion 16 having a rowel 18 rotatably mounted therein, as by pivot pin 20. A flange 22 projects inwardly from and abuts the lower edge 24 of band member 12.

As shown in FIGS. 1–3, spur 10 includes a pair of button assemblies 48, which are generally disposed at opposite ends of band 12. Each button assembly 48 includes a swivel plate 54 rotatably attached to clamp 52. Clamp 52 is fixedly attached, preferably by welding or by integral molding techniques, to band 12. A button 56 is attached to swivel plate 54 by means of a rivet 60 that extends through an opening in swivel plate 54 and into the shaft 58 extending from button 56.

As shown in FIG. 3, a buckled strap 28 is releasably attached to each of the buttons 56 of spur 10. Strap 28 extends along the upper surface 34 of the foot of the boot and above the instep 38 of the boot. Lip 22 of spur 10 is inserted into the gap 40 between the heel 36 and the foot 42 of the boot 34, with the band 12 extending around the rear of the boot 34. Shank 14 and rowel 18 are thereby maintained in the proper operating position. Furthermore, lip 22 prevents the upward displacement of band 12, thereby preventing spur 10 from "riding up" and positively maintaining the shank 14 and rowel 18 in the proper position.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features that come within the spirit and scope of the invention.

What is claimed is:

1. A riding spur for use in conjunction with a boot having a foot portion and an adjacent heel disposed below said foot portion, said spur comprising a generally Unshaped band member having an unbroken lip projecting inwardly therefrom, said lip abutting and extending along the entire band member lower edge, said lip having an inner edge that extends equidistantly from said band member, said lip inner edge terminating in a blunt inner face that extends along the entire band member lower edge, wherein said U-shaped band member is substantially parallel at the opposite ends of said band member.

2. The riding spur of claim 1 further comprising a shaft having a pointed projection extending rearwardly from said band member for Engagement with a horse.

3. The riding spur of claim 2 wherein said pointed projection comprises a rowel.

4. The riding spur of claim 3 wherein said rowel is rotatably mounted on said shaft.

5. The riding spur of claim 1 wherein said lip is insertable into a gap formed between said heel and said foot portion of said boot.

6. A riding spur in combination with a riding boot having a foot portion and a heel mounted therebelow, said riding spur comprising a generally U-shaped band member having an unbroken lip projecting inwardly therefrom, said lip abutting and extending along the entire band member lower edge, said lip having an inner edge that extends equidistantly from said band member, said lip inner edge terminating in a blunt inner face that extends along the entire band member lower edge, wherein said U-shaped band member is substantially parallel at the opposite ends of said band member.

7. The riding spur of claim 6 further comprising a shaft having a pointed projection extending rearwardly from said band member for engagement with a horse.

8. The riding spur of claim 7 wherein said pointed projection comprises a rowel.

9. The riding spur of claim 8 wherein said rowel is rotatably mounted on said shaft.

10. The riding spur of claim 6 wherein said lip is insertable in a gap formed between said heel and said foot portion of said boot.

11. The riding spur of claim 10 further comprising a button assembly for releasably attaching a strap to secure said spur to said boot.

12. The riding spur of claim 11 wherein said strap extends around the upper surface of said foot portion of said boot forwardly of said heel.

* * * * *

UNITED STATES PATENT AND TRADEMARK OFFICE

CERTIFICATE OF CORRECTION

PATENT NO. : 6,192,663 B1
DATED : February 27, 2001
INVENTOR(S) : Jerry J. Gatlin, Trigg Marquiss It is certified that error appears in the above-identified patent and that said Letters Patent is hereby corrected as shown below:

Column 3, claim 1,
Line 20, the word "Unshaped" should read -- U-shaped --.

Signed and Sealed this

Nineteenth Day of March, 2002

*Attest:*

JAMES E. ROGAN
*Director of the United States Patent and Trademark Office*

*Attesting Officer*